US007869616B2

(12) United States Patent
Harvey et al.

(10) Patent No.: US 7,869,616 B2
(45) Date of Patent: Jan. 11, 2011

(54) ACTIVE CROSSOVER AND WIRELESS INTERFACE FOR USE WITH MULTI-DRIVER IN-EAR MONITORS

(75) Inventors: Jerry J. Harvey, Lake Ozark, MO (US); Medford Alan Dyer, San Diego, CA (US)

(73) Assignee: Logitech International, S.A. (CH)

( * ) Notice: Subject to any disclaimer, the term of this patent is extended or adjusted under 35 U.S.C. 154(b) by 1294 days.

(21) Appl. No.: 11/413,668

(22) Filed: Apr. 27, 2006

(65) Prior Publication Data

US 2006/0193480 A1 Aug. 31, 2006

Related U.S. Application Data

(63) Continuation-in-part of application No. 11/034,144, filed on Jan. 12, 2005, now Pat. No. 7,194,103.

(60) Provisional application No. 60/696,685, filed on Jul. 5, 2005.

(51) Int. Cl.
*H04R 25/00* (2006.01)

(52) U.S. Cl. ..... 381/380; 381/384

(58) Field of Classification Search ..... 381/23.1, 381/74, 184, 312, 324, 328, 370, 380, 384; 379/184, 428.01; 455/344, 575.1, 575.2
See application file for complete search history.

(56) References Cited

U.S. PATENT DOCUMENTS 5,694,475 A * 12/1997 Boyden ..... 381/370
2005/0058311 A1* 3/2005 Branom ..... 381/384

* cited by examiner

*Primary Examiner*—Brian Ensey
(74) *Attorney, Agent, or Firm*—Patent Law Office of David G. Beck

(57) ABSTRACT

A headset with an active crossover network is provided. The headset is coupleable to a first audio source using a wired connection and to a second audio source using a wireless connection. A controller is used to determine whether the first, or second, audio source is coupled to the active crossover network which, utilizing either analog or digital filtering, divides each channel of the incoming audio signal into multiple frequency regions sufficient for the number of drivers contained within the in-ear monitors of the headset. The output from the network's filters is amplified using either single channel or multi-channel amplifies. Preferably, gain control circuitry is used to control the gain of the amplifier(s) and thus the volume produced by the drivers. More preferably, the gain of the gain control circuitry is adjustable. The headset includes a power source that is coupled to the amplifier(s) and, if necessary, the network's filters. The power source can be included within some portion of the headset or included within the wireless interface. Alternately, an external power source can be used, for example one associated with the audio source.

24 Claims, 7 Drawing Sheets

ACTIVE CROSSOVER AND WIRELESS INTERFACE FOR USE WITH MULTI-DRIVER IN-EAR MONITORS

CROSS-REFERENCES TO RELATED APPLICATIONS

This application is a continuation-in-part of U.S. patent application Ser. No. 11/034,144, filed Jan. 12, 2005 now U.S. Pat. No. 7,194,103 and claims the benefit of U.S. Provisional Patent Application Ser. No. 60/696,685, filed Jul. 5, 2005, the disclosures of which are incorporated herein by reference for any and all purposes.

FIELD OF THE INVENTION

The present invention relates generally to audio monitors and, more particularly, to multi-driver in-ear monitors.

BACKGROUND OF THE INVENTION

Earpieces, also referred to as in-ear monitors and canal-phones, are commonly used to listen to both recorded and live music. A typical recorded music application would involve plugging the earpiece into a music player such as a CD player, flash or hard drive based MP3 player, home stereo or similar device using the earpiece's headphone jack. Alternately, the earpiece can be wirelessly coupled to the music player. In a typical live music application, an on-stage musician wears the earpiece in order to hear his or her own music during a performance. In this case, the earpiece is either plugged into a wireless belt pack receiver or directly connected to an audio distribution device such as a mixer or a headphone amplifier.

Earpieces are quite small and are normally worn just outside the ear canal. As a result, the acoustic design of the earpiece must lend itself to a very compact design utilizing miniature components. Some earpieces are custom fit (i.e., custom molded) while others use a generic "one-size-fits-all" earpiece.

Although both in-ear monitors and headphones offer the user the ability to hear a source in stereo, the source being either recorded or live audio material, in-ear monitors offer significant advantages. First, in-ear monitors are so small that they are practically invisible to people that are at any distance from the user, a distinct advantage to a musician who would like to discretely achieve the benefits of headphones on stage (e.g., improved gain-before-feedback, minimization/elimination of room/stage acoustic effects, cleaner mix through the minimization of stage noise, etc.). Second, due to their size, in-ear monitors have little, if any, effect on the mobility of the user (e.g., musician, sports enthusiast, etc.). Third, in-ear monitors can more easily block out ambient sounds than a set of headphones, thus allowing them to operate at lower sound pressure levels than typical headphones in the same environment, thereby helping to protect the user's hearing.

Prior art in-ear monitors and headphones typically use one or more diaphragm-based drivers. Broadly characterized, a diaphragm is a moving-coil speaker with a paper or mylar diaphragm. Since the cost to manufacture diaphragms is relatively low, they are widely used in most common audio products (e.g., ear buds). Unfortunately due to the size of such drivers, earpieces utilizing diaphragm drivers are typically limited to a single diaphragm. As diaphragm-based monitors have significant frequency roll off above 4 kHz, an earpiece with a single diaphragm cannot achieve the desired upper frequency response while still providing an accurate low frequency response.

An alternate to diaphragm drivers are armature drivers, also referred to as balanced armatures. This type of driver uses a magnetically balanced shaft or armature within a small, typically rectangular, enclosure. Due to the inherent cost of armature drivers, however, they are typically only found in hearing aids and high-end in-ear monitors.

A single armature is capable of accurately reproducing low-frequency audio or high-frequency audio, but incapable of providing high-fidelity performance across all frequencies. To overcome this limitation, armature-based earpieces often use two, or even three, armature drivers. Alternately, a combination of armature and diaphragm drivers can be used. In such multiple driver arrangements a crossover network is used to divide the frequency spectrum into multiple regions, i.e., low and high or low, medium, and high. Separate drivers are then used for each region with each driver being optimized for a particular region. Typically the crossover network is a passive network, thus eliminating the necessity for a separate power source, e.g., a battery, for the headset.

SUMMARY OF THE INVENTION

The present invention provides a headset with an active crossover network. The headset is coupleable to a first audio source using a wired connection (e.g., stereo jack, USB connection, or other compatible interface) and to a second audio source using a wireless connection (e.g., Bluetooth® , 802.11b, 802.11g, etc.). A controller is used to determine whether the first, or second, audio source is coupled to the active crossover network which, utilizing either analog or digital filtering, divides each channel of the incoming audio signal into multiple frequency regions sufficient for the number of drivers contained within the in-ear monitors of the headset. The output from the network's filters is amplified using either single channel or multi-channel amplifies. Preferably, gain control circuitry is used to control the gain of the amplifier(s) and thus the volume produced by the drivers. More preferably, the gain of the gain control circuitry is adjustable. The headset includes a power source that is coupled to the amplifier(s) and, if necessary, the network's filters (e.g., for digital filters). The power source can be included within some portion of the headset (e.g., in-ear monitor housings, stereo jack, separate enclosure, etc.) or included within the wireless interface (e.g., Bluetooth® interface power source). Alternately, an external power source can be used, for example one associated with the audio source.

A further understanding of the nature and advantages of the present invention may be realized by reference to the remaining portions of the specification and the drawings.

DESCRIPTION OF THE SPECIFIC EMBODIMENTS

Figure 1:
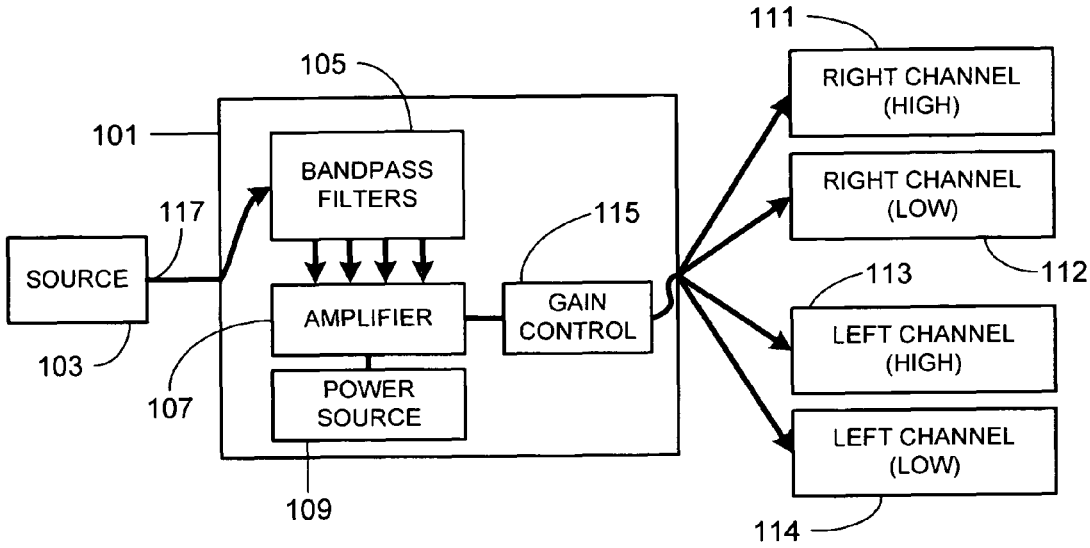
FIG. 1 is a block diagram of the primary components of an embodiment of the invention.

FIG. 1 is a block diagram illustrating the primary components of the invention. The active crossover network 101 accepts an audio input signal from a source 103. The filters 105 (e.g., bandpass filters) within the crossover network separate the audio spectrum of the incoming audio signal into the appropriate number of frequency regions based on the number of drivers per channel. Thus in the example illustrated in FIG. 1, bandpass filters 105 separate the incoming audio spectrum into left and right channel high frequencies and left and right channel low frequencies. After frequency separation, each frequency region is amplified using either a single multi-channel amplifier 107 as shown, or multiple single channel amplifiers. Amplifier 107 is coupled to a power source 109. Drivers 111-114 are coupled to amplifier 107, drivers 111-114 outputting, respectively, right channel, high frequencies; right channel, low frequencies; left channel, high frequencies; and left channel, low frequencies. Drivers 111-114 may be comprised of diaphragm drivers, armature drivers, or some combination of the two (e.g., diaphragm drivers for the low frequencies and armature drivers for the high frequencies). A gain controller 115 controls the gain of amplifier 107, i.e., the volume of each driver 111-114. Depending upon the desired complexity and cost of the gain controller, it can either provide simultaneous control of all drivers; individual control of the left and right channels but with simultaneous control over all of the drivers associated with each channel; or individual control of each driver. In at least one embodiment of the invention, for example one in which the active crossover network is intended to be coupled to the headphone output of a device as opposed to a line-level output, the gain controller is fixed rather than being variable.

Figure 2:
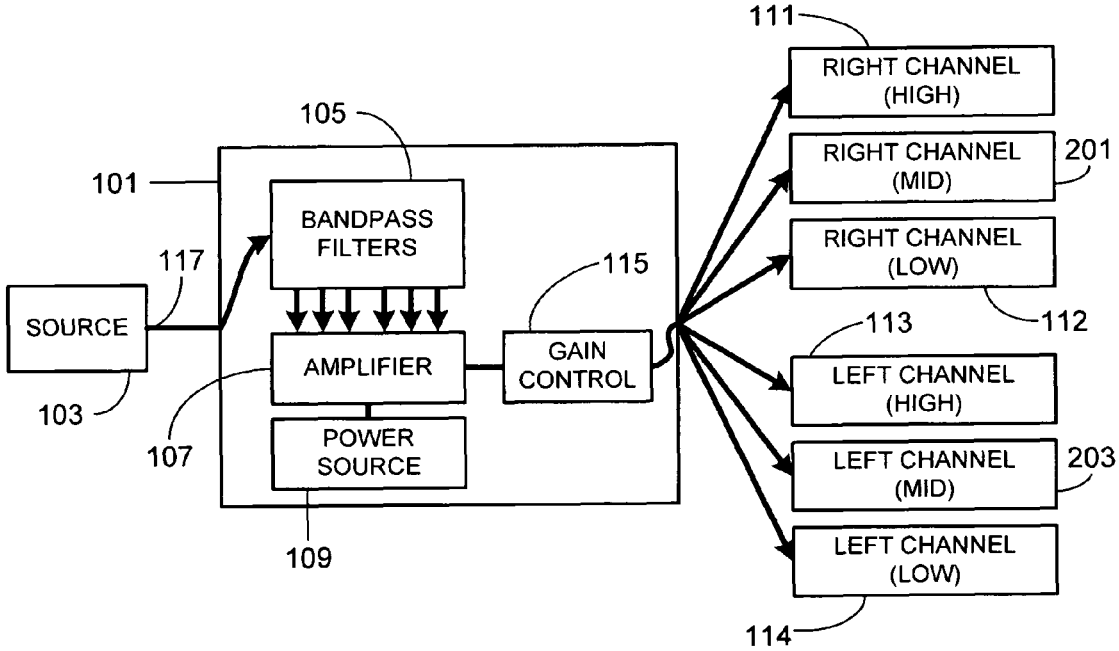
FIG. 2 is a block diagram of the primary components of an embodiment utilizing three drivers per channel.

It will be appreciated that the present invention is not limited to stereo headsets utilizing only a pair of drivers per channel. For example, FIG. 2 is a block diagram of the primary components of an embodiment in which each headset channel includes three drivers, i.e., a right channel high frequency driver 111, a left channel high frequency driver 113, a right channel mid frequency driver 201, a left channel mid frequency driver 203, a right channel low frequency driver 112, and a left channel low frequency driver 114. As in the previous embodiment, any combination of diaphragm drivers and armature drivers can be used, the selection dependent primarily on cost and size constraints. For example, a headphone headset will typically utilize only diaphragm drivers as driver size is not an issue while a headset utilizing canalphones (i.e., in-ear monitors) will typically utilize at least one armature driver, and preferably at least two armature drivers, due to their small size.

The invention is not limited to a specific type of source 103, although it will be appreciated that preferably the active crossover network of the invention is coupled to the line-level output 117 of source 103, i.e., pre-power amplification. If the active crossover network of the invention is coupled to the standard amplified output of the source, for example the headphone jack of an MP3 player, then undesirable distortion may arise due to the audio signal being amplified both within the source and by the active crossover network. More importantly, the benefits of the active crossover network are not fully realized in such an implementation. Many audio components, both portable and non-portable components, provide a line-level output, often referred to as the "line out". Such an output allows the component to be coupled to an out-board amplifier, typically of higher audio quality that that provided by the on-board amplifier. For example, iPod® music players as well as portable Sirius® and XM® satellite radio receivers provide a line-level output, thus allowing the devices to be coupled to car audio systems, home audio systems, or other high performance systems.

Figure 3:
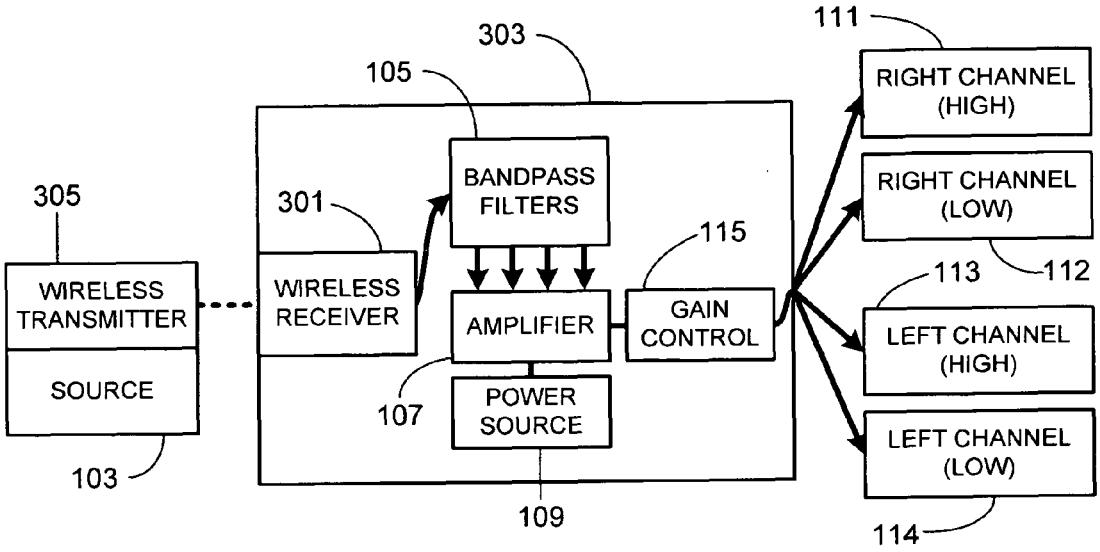
FIG. 3 is a block diagram of the primary components of an embodiment utilizing two drivers per channel and including a wireless interface.
Figure 4:
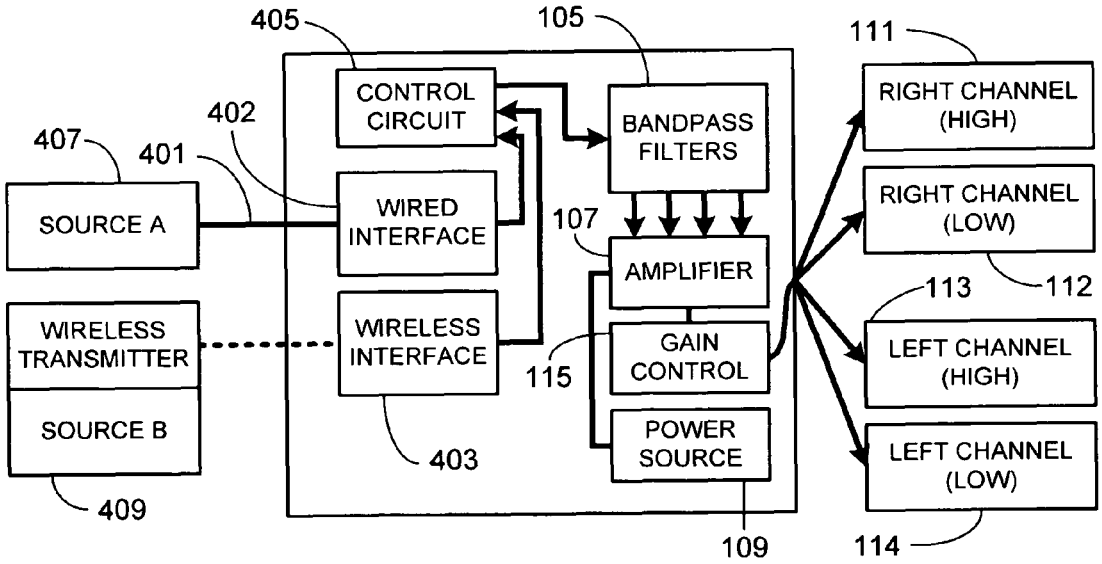
FIG. 4 is a block diagram of the primary components of an embodiment utilizing two drivers per channel and including both a wired and a wireless interface.

As previously noted, preferably the crossover network of the invention is coupled to the line-level output of the source. It will be appreciated that regardless of the number of drivers per channel, the active crossover network of the present invention can be coupled to the line level output using any convenient coupling means. For example, in a preferred embodiment of the invention, a standard stereo jack, for example an ⅛ inch or ¼ inch jack, is used. Alternately, a USB connector is used. Alternately, a connector designed to match a specific interface is used, for example a connector designed to match the docking port on an iPod® , Sirius® satellite receiver or XM® satellite receiver. Alternately, and as illustrated in FIG. 3, a Bluetooth® or similar (e.g., 802.11b, 802.11g capable) wireless receiver 301 is included within, or attached to, the enclosure 303 housing active crossover network 101. The line-level output is then transmitted wirelessly via a compatible wireless transmitter 305, e.g., a Bluetooth® , 802.11b, 802.11g, or other transmitter capable of wireless communication with wireless receiver 301. Alternately, and as illustrated in FIG. 4, the system can include both a conventional coupling means 401/402 and a wireless coupling means 403 (e.g., Bluetooth® , 802.11b, 802.11g, or other wireless interface). The inclusion of two coupling means allow the headset to be connected to the source using either wires or wirelessly. Although a simple switch can be used to toggle between the two coupling means, preferably a control circuit 405 is used to toggle between the two coupling means, for example by sensing which coupling means is connected to a source. Alternately, control circuit 405 can allow both coupling means to be simultaneously connected to two different sources, for example a music source 407 via the wired coupling means and a cellular telephone 409 via the wireless coupling means. Preferably in this embodiment circuit 405 mutes the input from the wired source (e.g., music source) whenever the wireless source (e.g., cellular telephone) is in use.

Figure 5:
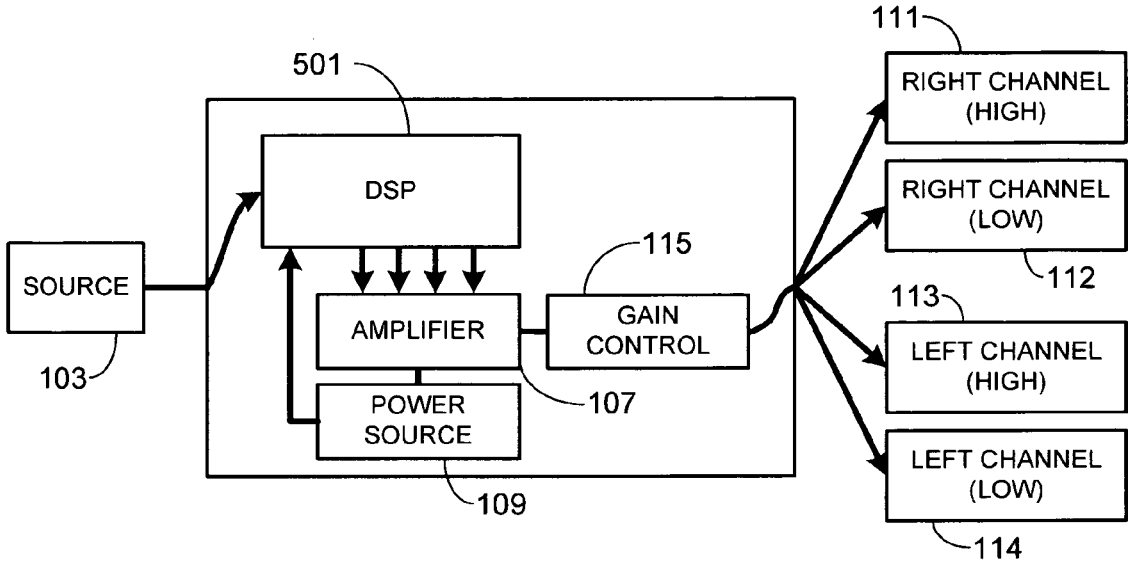
FIG. 5 is a block diagram of the primary components of an embodiment utilizing two drivers per channel and including a digital signal processor.

In a preferred embodiment, bandpass filters 105 are simple analog filters. If greater design flexibility and/or lower insertion losses are desired, preferably the input signals are digitally processed, for example using a digital signal processor (DSP) 501 as illustrated in FIG. 5. DSP 501 is used to set the crossover points (i.e., crossover frequencies), filter slopes and, if desired, output levels for each driver. For illustration purposes, DSP is shown in a system similar to that of FIG. 1. It should be understood, however, that digital signal processing can be used with any of the embodiments of the invention.

Figure 6:
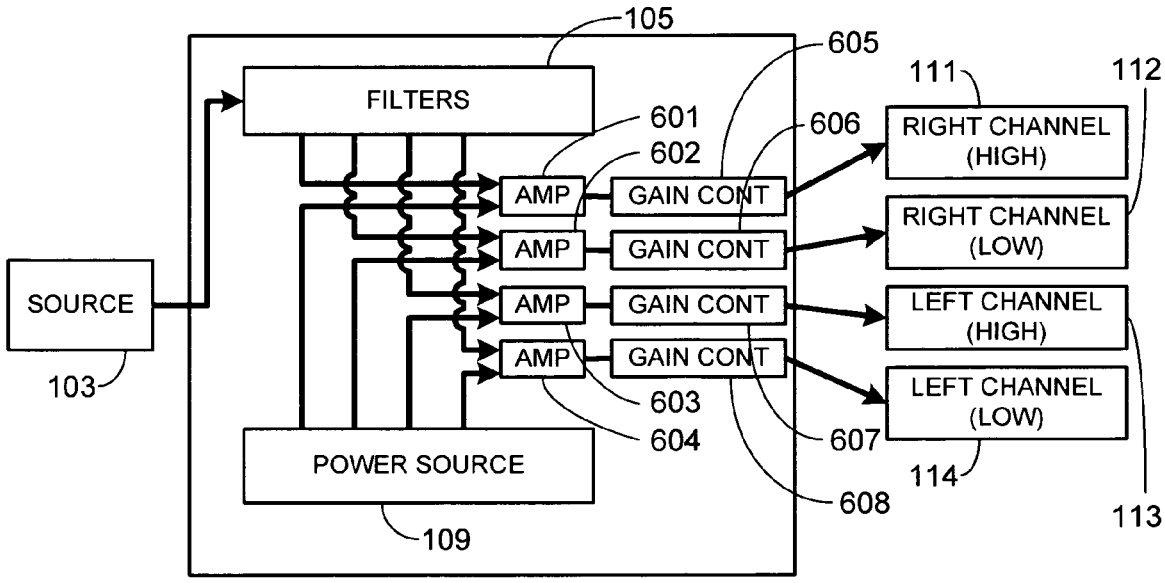
FIG. 6 is a block diagram of the primary components of an embodiment utilizing two drivers per channel and including four single channel amplifiers.
Figure 7:
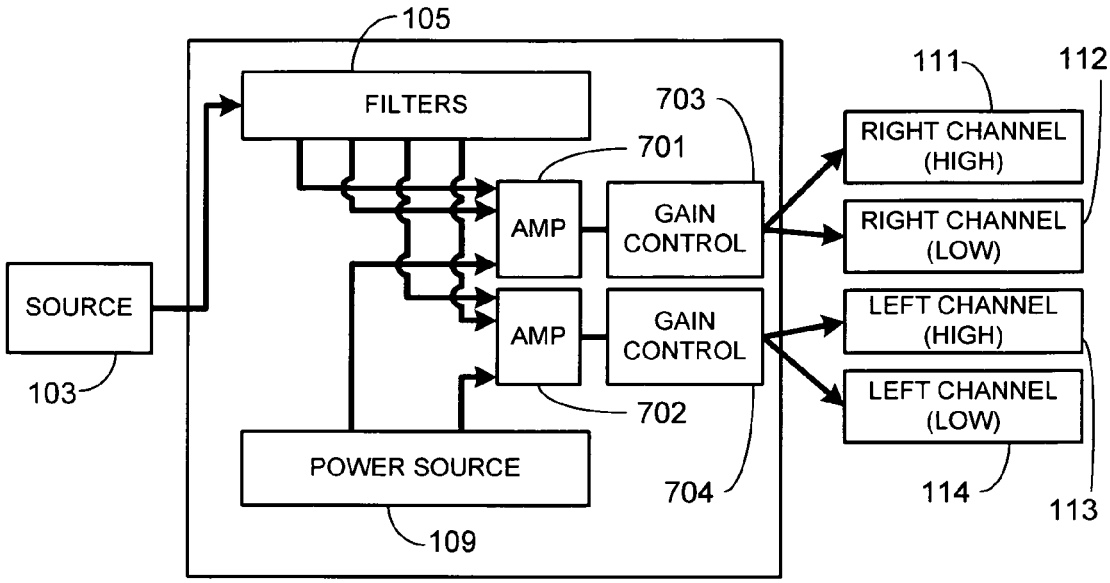
FIG. 7 is a block diagram of the primary components of an embodiment utilizing two drivers per channel and including two dual channel amplifiers.

In the embodiments illustrated in FIGS. 1-5, the output of the bandpass filters, either analog filters 105 or DSP 501, is amplified by amplifier 107. It will be appreciated that amplifier 107 either includes at least as many amplifier sections (i.e., channels) as the number of drivers within the headset, or multiple amplifiers must be used. For example, FIG. 6 is an illustration of a system similar to that of FIG. 1, with amplifier 107 being replaced by four single channel amplifiers 601-604, each with its own gain controller 605-608, respectively. Similarly, FIG. 7 is an illustration of a system similar to that of FIG. 1, with amplifier 107 being replaced by two dual channel amplifiers 701-702, each with its own gain controller 703 and 704, respectively. It should also be appreciated that the amplifier(s) does not have to be housed within the same enclosure as the filters. For example, in the embodiment illustrated in FIG. 8, which assumes two drivers per channel, each headset channel 801/802 (i.e., right/left headphones or right/left in-ear monitors) includes an amplifier or, more preferably, a dual channel amplifier (i.e., 803/804) and its own gain controller (i.e., 809/810). Preferably each headset channel (i.e., each headphone or in-ear monitor) also includes its own power source (i.e., batteries 805/806). Alternately, as shown in FIG. 9, the power source 901 can be housed within the same enclosure 903 as that housing the crossover network 905 and connected to amplifiers 803/804 via coupling cables 807/808.

Figure 10:
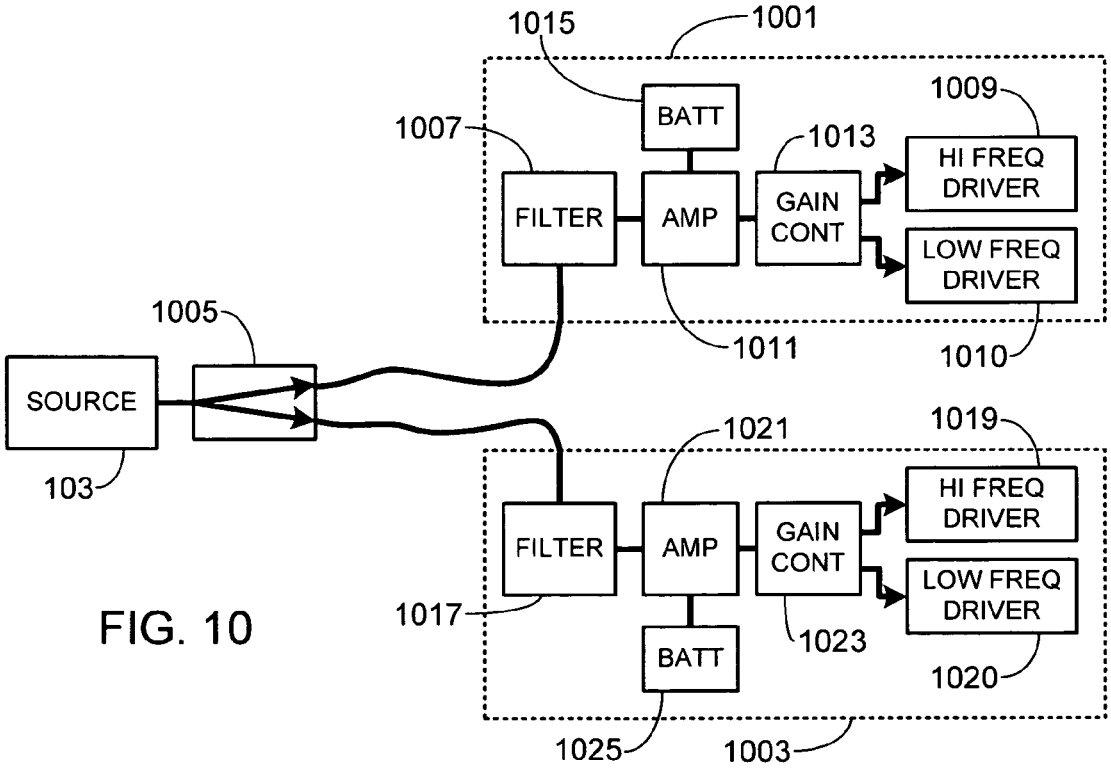
FIG. 10 is a block diagram of the primary components of an embodiment in which the left/right channel signals are separated within the jack assembly and in which all left/right channel signal processing components are contained within the respective left/right channel headphone/in-ear monitor housings.

In an alternate embodiment of the invention, illustrated in FIG. 10, the entire active crossover network for the left channel is housed within the headset's left channel headphone/in-ear monitor housing 1001 and the entire active crossover network for the right channel is housed within the headset's right channel headphone/in-ear monitor housing 1003. In this embodiment the left and right channels are split within the source coupling interface 1005. In at least one configuration interface 1005 is comprised of a stereo jack assembly. Then filters 1007, either analog or digital filters, separate the left channel signal into a sufficient number of frequency regions for the designated number of drivers (e.g., two drivers 1009/1010). Each frequency region is amplified by an amplifier 1011 (e.g., a dual channel amplifier or two single channel amplifiers for the exemplary dual driver configuration). Preferably also contained within housing 1001 are gain control circuitry 1013 and a power source 1015. Similar components are contained within right channel housing 1003, i.e., filters 1017, drivers 1019/1020, amplifier 1021, gain control circuitry 1023 and power source 1025.

Figure 8:
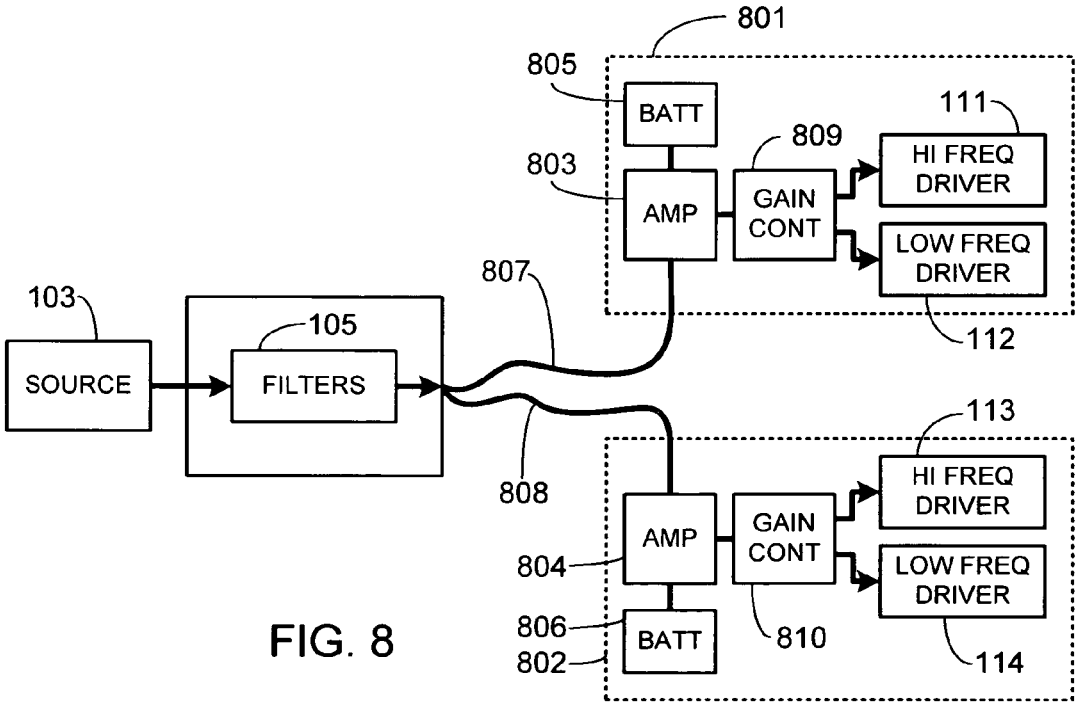
FIG. 8 is a block diagram of the primary components of an embodiment in which the driver amplifiers and the amplifiers' power sources are contained within the headset's left channel and right channel housings.
Figure 9:
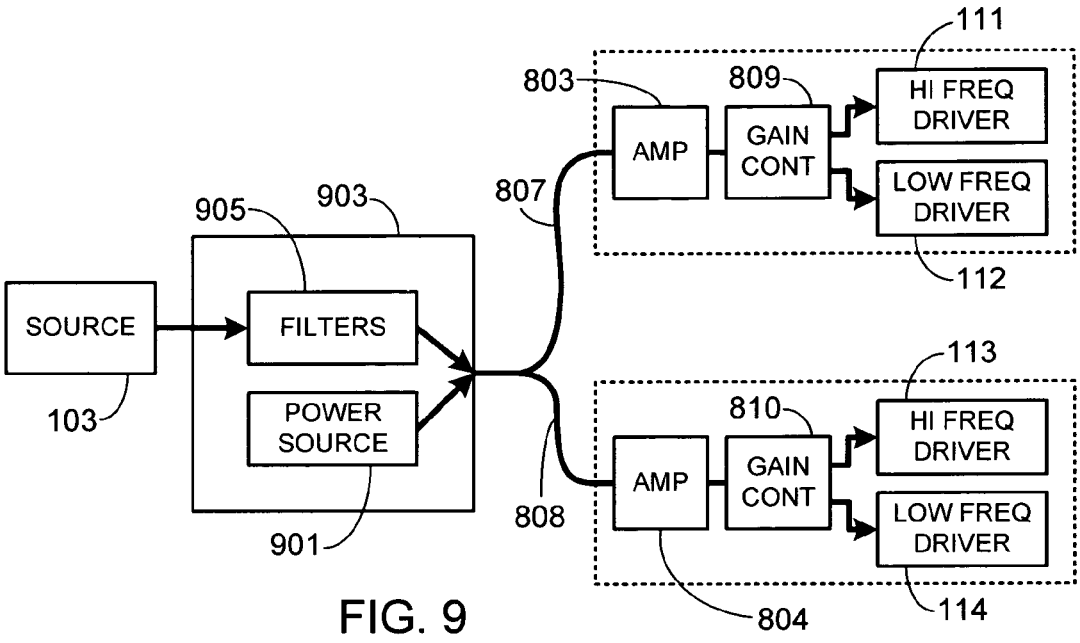
FIG. 9 is a block diagram of the primary components of an embodiment in which the driver amplifiers are contained within the headset's left channel and right channel housings and coupled to the power source contained within the crossover network's enclosure.

As previously described, the power source for the active crossover network, i.e., for the individual driver amplifiers and for the filters if necessary (e.g., DSP), can either be housed within the enclosure housing the crossover network (e.g., FIGS. 1-7 and 9) or within the headset itself (e.g., FIGS. 8 and 10). If the power source is contained within the headset itself, the exact configuration depends on the type of headset. For example, if the headset is a headphone headset, batteries can be included in one or both headphone enclosures or in the head strap (or neck strap) attached to the two headphone enclosures. If the headset is a set of canalphones (i.e., in-ear monitors) and the power source is contained within the headset, each in-ear monitor includes one or more miniature batteries, such as those often used with hearing aids.

Figure 11:
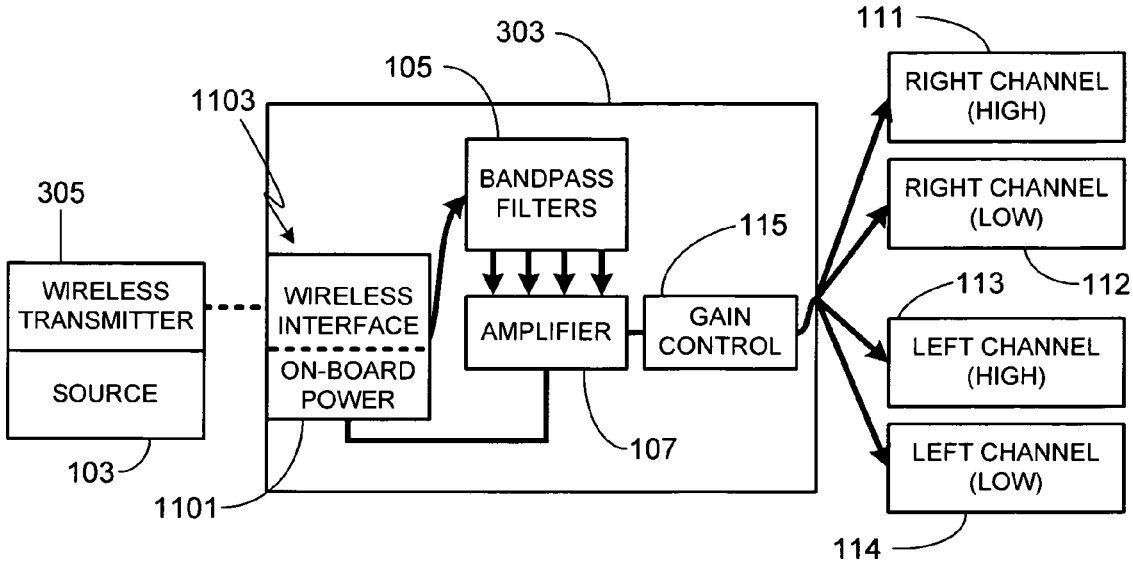
FIG. 11 is a block diagram of the primary components of an embodiment similar to that shown in FIG. 3, except for the use of the power source of the wireless interface to provide power to the active crossover network.

It will be appreciated that the invention can also utilize other power sources. For example, the battery used with a wireless interface (e.g., Bluetooth® or other) can be used to provide power to the active crossover circuitry. FIG. 11, based on the embodiment shown in FIG. 3, illustrates such a configuration in which power for the active crossover network is taken from power source 1101 which is part of wireless interface 1103. It will be appreciated that the same approach can be used with other embodiments, such as the one shown in FIG. 4.

Figure 12:
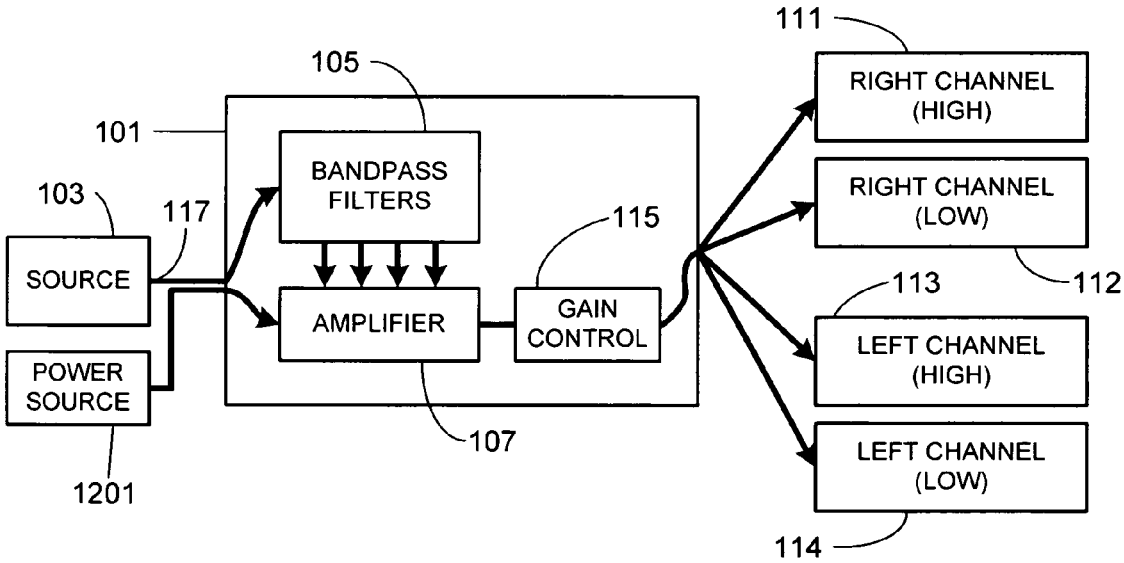
FIG. 12 illustrates an embodiment similar to that shown in FIG. 1, except that the system is attached to an external power source as well as an external audio source.

In addition to utilizing power sources as described above, power can also be taken from an outside source. For example, FIG. 12 illustrates an embodiment similar to that shown in FIG. 1, except that the system is attached to an external power source 1201 as well as an external audio source 103. In at least one embodiment of the invention, a single interface is used to couple to both power source 1201 and audio source 103, for example an interface compatible with an iPod® docking port, Sirius® satellite receiver docking port, XM® satellite receiver docking port, or other device's docking port. It should be understood that the use of an external power source is compatible with any of the embodiments of the invention.

Regardless of the number of drivers per channel, power source location, analog or digital circuitry, amplifier and gain control configuration, and headset type, the system of the invention can be housed in a number of locations. For example, some or all aspects of the system, with the obvious exclusion of the drivers, can be housed in the interface connector enclosure (e.g., stereo jack). Alternately, such components can be maintained in an enclosure attached to the cable and situated between the interface connector and the headset. Alternately, such components can be housed within the headset itself. Alternately, some of the components (e.g., bandpass filters, power source) can be housed in a first location (e.g., interface connector enclosure) with the remaining components (e.g., amplifiers, gain controls) housed in a second location (e.g., within the left/right channel headphones or canalphones).

Figure 13:
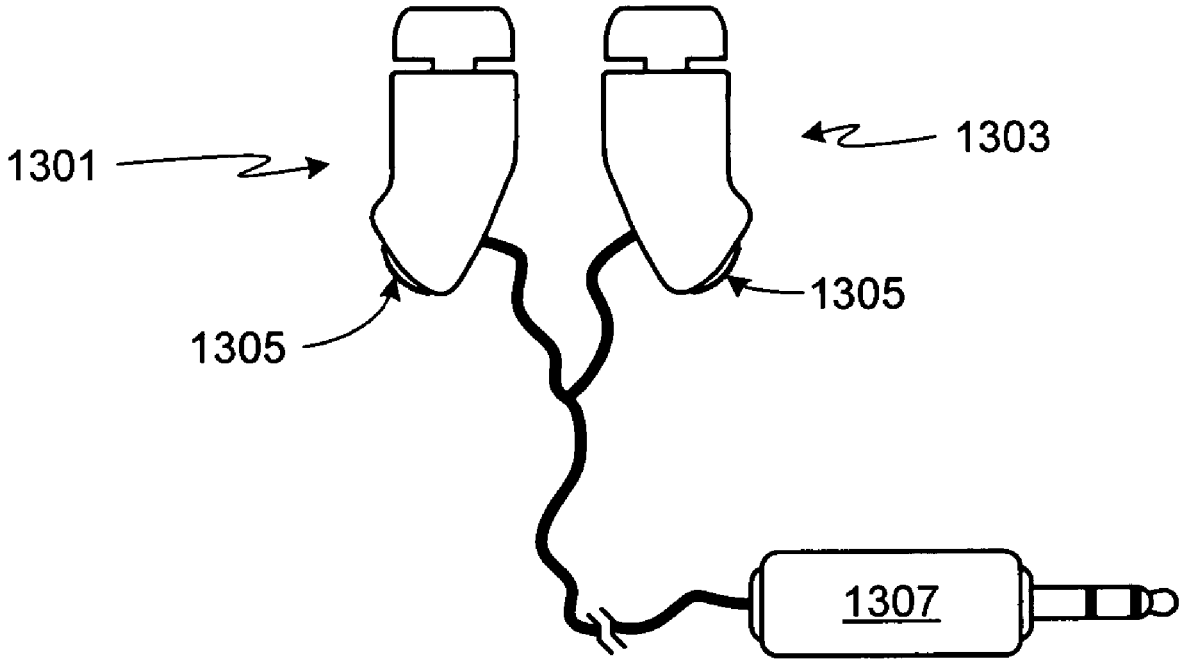
FIG. 13 further illustrates the embodiment of the invention shown in FIG. 9.

Although the invention has been described in detail above, FIG. 13 further illustrates one embodiment of the invention, specifically the embodiment shown in FIG. 9. As shown, the headset is comprised of a pair of in-ear monitors (i.e., canalphones) 1301 and 1303 each of which includes a pair of drivers, a dual channel amplifier and a gain controller. At the end of each in-ear monitor is a thumb-rotatable switch 1305 that controls the gain of the amplifier, and thus the volume delivered by the drivers. Headphone jack 1307, in addition to coupling the crossover network to the source, also houses the network's bandpass filters and the power supply for the driver amplifiers. Exemplary in-ear monitors are described in detail in co-pending U.S. patent application Ser. Nos. 11/034,144, filed Jan. 12, 2005, 11/044,510, filed Jan. 27, 2005, and 11/051,865, filed Feb. 4, 2005, the disclosures of which are incorporated herein for any and all purposes.

As will be understood by those familiar with the art, the present invention may be embodied in other specific forms without departing from the spirit or essential characteristics thereof. Accordingly, the disclosures and descriptions herein are intended to be illustrative, but not limiting, of the scope of the invention which is set forth in the following claims.

What is claimed is:

1. A headset, comprising:

means for coupling the headset to a first audio source, said first audio source having at least a first audio channel and a second audio channel;

a wireless interface for coupling the headset to a second audio source;

a controller coupled to said coupling means and said wireless interface, said controller capable of a first operating configuration and a second operating configuration;

a crossover network, wherein when said controller is in said first operating configuration said crossover network is coupled to said first audio source and wherein when said controller is in said second operating configuration said crossover network is coupled to said second audio source, and wherein when said crossover network is coupled to said first audio source said crossover network divides said first audio channel into at least a first frequency region and a second frequency region and divides said second audio channel into at least a third frequency region and a fourth frequency region, and wherein said crossover network outputs a first audio signal corresponding to said first frequency region, a second audio signal corresponding to said second frequency region, a third audio signal corresponding to said third frequency region, and a fourth audio signal corresponding to said fourth frequency region, and wherein said crossover network further comprises:

a first amplifier, wherein said first amplifier amplifies said first audio signal and outputs a first amplified audio signal;

a second amplifier, wherein said second amplifier amplifies said second audio signal and outputs a second amplified audio signal;

a third amplifier, wherein said third amplifier amplifies said third audio signal and outputs a third amplified audio signal;

a fourth amplifier, wherein said fourth amplifier amplifies said fourth audio signal and outputs a fourth amplified audio signal; and at least one power source coupled to said first, second, third and fourth amplifiers; and a first in-ear monitor comprising at least a first driver and a second driver, wherein said first driver is coupled to said first amplifier and receives said first amplified audio signal and said second driver is coupled to said second amplifier and receives said second amplified audio signal; and a second in-ear monitor comprising at least a third driver and a fourth driver, wherein said third driver is coupled to said third amplifier and receives said third amplified audio signal and said fourth driver is coupled to said fourth amplifier and receives said fourth amplified audio signal.

2. The headset of claim 1, wherein when said crossover network is coupled to said second audio source said crossover network said crossover network divides said second audio source signal into at least said first frequency region and said second frequency region, and wherein said crossover network outputs said first audio signal corresponding to said first frequency region and a second audio signal corresponding to said second frequency region.

3. The headset of claim 1, wherein said second audio source signal is comprised of at least a first alternative audio channel and a second alternative audio channel, and wherein when said crossover network is coupled to said second audio source said crossover network divides said first alternative audio channel into at least said first frequency region and said second frequency region and divides said second alternative audio channel into at least said third frequency region and said fourth frequency region, and wherein said crossover network outputs said first audio signal corresponding to said first frequency region, said second audio signal corresponding to said second frequency region, said third audio signal corresponding to said third frequency region, and said fourth audio signal corresponding to said fourth frequency region.

4. The headset of claim 1, wherein said controller comprises a switch with at least a first position and a second position, wherein said first position corresponds to said first configuration and said second position corresponds to said second configuration.

5. The headset of claim 1, wherein said second audio source is a cellular telephone.

6. The headset of claim 1, wherein a first dual channel amplifier is comprised of said first amplifier and said second amplifier, and wherein a second dual channel amplifier is comprised of said third amplifier and said fourth amplifier.

7. The headset of claim 1, wherein a four channel amplifier is comprised of said first amplifier, said second amplifier, said third amplifier and said fourth amplifier.

8. The headset of claim 1, further comprising:

a first gain controller coupled to said first amplifier;

a second gain controller coupled to said second amplifier;

a third gain controller coupled to said third amplifier; and a fourth gain controller coupled to said fourth amplifier.

9. The headset of claim 8, wherein each of said first, second, third and fourth gain controllers are adjustable.

10. The headset of claim 1, further comprising:

a first gain controller coupled to said first amplifier and said second amplifier; and a second gain controller coupled to said third amplifier and said fourth amplifier.

11. The headset of claim 10, wherein said first and second gain controllers are adjustable.

12. The headset of claim 1, wherein said coupling means is comprised of a stereo jack.

13. The headset of claim 1, wherein said crossover network further comprises a plurality of analog bandpass filters, wherein said plurality of analog bandpass filters divides said first audio channel into at least said first frequency region and said second frequency region and divides said second audio channel into at least said third frequency region and said fourth frequency region.

14. The headset of claim 1, wherein said crossover network further comprises a digital circuit that divides said first audio channel into at least said first frequency region and said second frequency region and divides said second audio channel into at least said third frequency region and said fourth frequency region, and wherein said digital circuit is electrically coupled to said at least one power source.

15. The headset of claim 14, wherein said digital circuit is comprised of a digital signal processor.

16. The headset of claim 1, further comprising:

a first in-ear monitor housing corresponding to said first in-ear monitor, wherein said first driver and said second driver are contained within said first in-ear monitor housing; and a second in-ear monitor housing corresponding to said second in-ear monitor, wherein said third driver and said fourth driver are contained within said second in-ear monitor housing.

17. The headset of claim 16, wherein said first amplifier and said second amplifier are contained within said first in-ear monitor housing, and wherein said third amplifier and said fourth amplifier are contained within said second in-ear monitor housing.

18. The headset of claim 17, wherein said at least one power source is comprised of at least a first power source coupled to said first and second amplifiers and a second power source coupled to said third and fourth amplifiers, wherein said first power source is contained within said first in-ear monitor housing, and wherein said second power source is contained within said second in-ear monitor housing.

19. The headset of claim 18, wherein said crossover network further comprises:

a first audio channel crossover network that divides said first audio channel into at least said first frequency region and said second frequency region, wherein said first audio channel crossover network is contained within said first in-ear monitor housing; and a second audio channel crossover network that divides said second audio channel into at least said third frequency region and said fourth frequency region, wherein said second audio channel crossover network is contained within said second in-ear monitor housing.

20. The headset of claim 1, further comprising:

a first in-ear monitor housing corresponding to said first in-ear monitor, wherein said first driver and said second driver are contained within said first in-ear monitor housing, and wherein said first amplifier and said second amplifier are contained within said first in-ear monitor housing;

a second in-ear monitor housing corresponding to said second in-ear monitor, wherein said third driver and said fourth driver are contained within said second in-ear monitor housing, and wherein said third amplifier and said fourth amplifier are contained within said second in-ear monitor housing;

a first gain controller coupled to said first amplifier and contained within said first in-ear monitor housing;

a second gain controller coupled to said second amplifier and contained within said first in-ear monitor housing;

a third gain controller coupled to said third amplifier and contained within said second in-ear monitor housing; and a fourth gain controller coupled to said fourth amplifier and contained within said second in-ear monitor housing.

21. The headset of claim 20, wherein said at least one power source is comprised of at least a first power source coupled to said first and second amplifiers and a second power source coupled to said third and fourth amplifiers, wherein said first power source is contained within said first in-ear monitor housing, and wherein said second power source is contained within said second in-ear monitor housing.

22. The headset of claim 21, wherein said crossover network further comprises:

a first audio channel crossover network that divides said first audio channel into at least said first frequency region and said second frequency region, wherein said first audio channel crossover network is contained within said first in-ear monitor housing; and a second audio channel crossover network that divides said second audio channel into at least said third frequency region and said fourth frequency region, wherein said second audio channel crossover network is contained within said second in-ear monitor housing.

23. The headset of claim 1, further comprising a means for coupling said at least one power source to said headset, wherein said at least one power source is external to said headset.

24. The headset of claim 23, wherein said means for coupling the headset to said audio source and said means for coupling the headset to said at least one power source are combined into a single interface assembly.

* * * * *